US012703902B2

(12) United States Patent
Umetani et al.

(10) Patent No.: US 12,703,902 B2
(45) Date of Patent: Aug. 11, 2026

(54) IRON ALLOY MATERIAL FOR CASTING AND IRON CASTING

(71) Applicant: HINODE, LTD., Fukuoka (JP)

(72) Inventors: Takuo Umetani, Fukuoka (JP); Tomohiro Ikeda, Fukuoka (JP); Koki Takeya, Fukuoka (JP); Kota Takahashi, Fukuoka (JP)

(73) Assignee: HINODE, LTD., Fukuoka (JP)

( * ) Notice: Subject to any disclaimer, the term of this patent is extended or adjusted under 35 U.S.C. 154(b) by 427 days.

(21) Appl. No.: 18/027,845

(22) PCT Filed: Oct. 18, 2021

(86) PCT No.: PCT/JP2021/038484
§ 371 (c)(1),
(2) Date: Mar. 22, 2023

(87) PCT Pub. No.: WO2022/085642
PCT Pub. Date: Apr. 28, 2022

(65) Prior Publication Data

US 2023/0332280 A1 Oct. 19, 2023

(30) Foreign Application Priority Data

Oct. 23, 2020 (JP) ..... 2020-178270

(51) Int. Cl.

| | |
|---|---|
| ***C22C 38/10*** | (2006.01) |
| ***C22C 37/10*** | (2006.01) |
| ***C22C 38/00*** | (2006.01) |
| ***C22C 38/02*** | (2006.01) |
| ***C22C 38/04*** | (2006.01) |
| ***C22C 38/60*** | (2006.01) |

(52) U.S. Cl.
CPC ..... *C22C 38/105* (2013.01); *C22C 37/10* (2013.01); *C22C 38/002* (2013.01); *C22C 38/02* (2013.01); *C22C 38/04* (2013.01); *C22C 38/60* (2013.01)

(58) Field of Classification Search
None
See application file for complete search history.

(56) References Cited

U.S. PATENT DOCUMENTS

2006/0191604 A1* 8/2006 Itoh ..... C22C 37/08 420/17
2008/0279716 A1* 11/2008 Nishiyama ..... B21K 1/10 420/452

(Continued)

FOREIGN PATENT DOCUMENTS

CN 1826421 A 8/2006
CN 104937122 A 9/2015

(Continued)

OTHER PUBLICATIONS

English language machine translation of CN-107287496-A. Generated Jun. 10, 2025. (Year: 2025).*

(Continued)

*Primary Examiner* — Brian D Walck
(74) *Attorney, Agent, or Firm* — Sughrue Mion, PLLC

(57) ABSTRACT

An iron alloy material for casting includes 0.3 to 3.5 mass % of C, 0.1 to 3.0 mass % of Si, 26.0 to 42.0 mass % of Ni, 0.02 to 0.50 mass % of Sb, and a balance that is Fe and an inevitable impurity/impurities.

1 Claim, 3 Drawing Sheets

| | COMPOSITION(MASS%) | | | | | | | | COEFFICIENT OF THERMAL EXPANSION ($\times 10^{-6}$/°C) | ELONGATION (%) |
|---|---|---|---|---|---|---|---|---|---|---|
| | C | Si | Mn | Ni | Sb | Mg | Co | Ni:Si | | |
| PRACTICAL EXAMPLE 1 | 2.46 | 1.55 | 0.16 | 31.8 | 0.032 | 0.058 | 4.91 | 21:1 | 3.25 | 29.0 |
| PRACTICAL EXAMPLE 2 | 1.68 | 2.04 | 0.14 | 32.9 | 0.046 | 0.054 | 5.02 | 16:1 | 2.53 | 29.1 |
| PRACTICAL EXAMPLE 3 | 2.46 | 1.56 | 0.14 | 31.2 | 0.068 | 0.058 | 4.91 | 20:1 | 3.32 | 20.9 |
| PRACTICAL EXAMPLE 4 | 2.27 | 1.52 | 0.11 | 36.6 | 0.073 | 0.066 | 0.026 | 24:1 | 3.02 | 34.4 |
| PRACTICAL EXAMPLE 5 | 2.47 | 1.55 | 0.10 | 31.7 | 0.076 | 0.060 | 4.81 | 20:1 | 3.28 | 27.0 |
| PRACTICAL EXAMPLE 6 | 1.47 | 0.81 | 0.82 | 32.7 | 0.078 | 0.066 | 4.94 | 40:1 | 2.76 | 20.0 |
| PRACTICAL EXAMPLE 7 | 1.51 | 2.48 | 0.10 | 33.0 | 0.078 | 0.066 | 4.93 | 13:1 | 2.71 | 25.7 |
| PRACTICAL EXAMPLE 8 | 2.24 | 0.92 | 0.11 | 32.8 | 0.079 | 0.065 | 4.84 | 36:1 | 2.61 | 28.4 |
| PRACTICAL EXAMPLE 9 | 2.33 | 1.58 | 0.12 | 31.8 | 0.087 | 0.057 | 4.60 | 20:1 | 3.06 | 27.0 |
| PRACTICAL EXAMPLE 10 | 2.84 | 0.38 | 0.11 | 32.9 | 0.089 | 0.063 | 5.00 | 87:1 | 3.18 | 17.0 |
| PRACTICAL EXAMPLE 11 | 2.50 | 1.42 | 0.10 | 31.7 | 0.090 | 0.057 | 4.97 | 22:1 | 2.90 | 27.0 |
| PRACTICAL EXAMPLE 12 | 2.42 | 1.54 | 0.12 | 33.3 | 0.090 | 0.060 | 5.25 | 22:1 | 2.98 | 28.2 |
| PRACTICAL EXAMPLE 13 | 2.46 | 1.57 | 0.11 | 32.1 | 0.093 | 0.053 | 4.86 | 20:1 | 2.47 | 29.3 |
| PRACTICAL EXAMPLE 14 | 1.01 | 1.43 | 0.10 | 33.1 | 0.100 | 0.063 | 5.08 | 23:1 | 2.22 | 21.3 |
| PRACTICAL EXAMPLE 15 | 2.46 | 1.55 | 0.10 | 32.1 | 0.100 | 0.059 | 5.00 | 21:1 | 3.17 | 27.0 |
| PRACTICAL EXAMPLE 16 | 2.31 | 1.47 | 0.11 | 32.5 | 0.150 | 0.054 | 4.90 | 22:1 | 3.04 | 29.8 |
| PRACTICAL EXAMPLE 17 | 2.31 | 1.47 | 0.11 | 32.5 | 0.260 | 0.054 | 4.90 | 22:1 | 3.13 | 31.2 |
| PRACTICAL EXAMPLE 18 | 2.31 | 1.47 | 0.11 | 32.5 | 0.320 | 0.054 | 4.90 | 22:1 | 3.09 | 27.9 |
| PRACTICAL EXAMPLE 19 | 2.34 | 1.47 | 0.11 | 31.8 | 0.350 | 0.047 | 4.87 | 22:1 | 3.22 | 26.2 |
| COMPARATIVE EXAMPLE 1 | 2.26 | 2.44 | 0.61 | 28.8 | 0.011 | 0.058 | 4.91 | 12:1 | 4.59 | 9.7 |
| COMPARATIVE EXAMPLE 2 | 2.34 | 1.47 | 0.11 | 31.8 | 0.550 | 0.047 | 4.87 | 22:1 | 3.31 | 16.8 |

(56) References Cited

U.S. PATENT DOCUMENTS

| | | | |
|---|---|---|---|
| 2015/0376747 | A1 | 12/2015 | Tyou et al. |
| 2016/0138139 | A1 | 5/2016 | Fujimoto et al. |

FOREIGN PATENT DOCUMENTS

| | | | | | |
|---|---|---|---|---|---|
| CN | 107287496 | A | * | 10/2017 | ..... C22C 37/04 |
| JP | 56-116854 | A | | 9/1981 | |
| JP | 63-093840 | A | | 4/1988 | |
| JP | 63-114936 | A | | 5/1988 | |
| JP | 06-179938 | A | | 6/1994 | |
| JP | 2001-192777 | A | | 7/2001 | |
| WO | 2005/007914 | A1 | | 1/2005 | |
| WO | 2015/034062 | A1 | | 3/2015 | |

OTHER PUBLICATIONS

International Search Report for PCT/JP2021/038484 dated Dec. 21, 2021.

Chinese Office Action dated Jun. 24, 2024 in Application No. 202180064450.5.

* cited by examiner

FIG.1

| | COMPOSITION(MASS%) | | | | | | | | COEFFICIENT OF THERMAL EXPANSION ($\times 10^{-6}$/°C) | ELON-GATION (%) |
|---|---|---|---|---|---|---|---|---|---|---|
| | C | Si | Mn | Ni | Sb | Mg | Co | Ni:Si | | |
| PRACTICAL EXAMPLE 1 | 2.46 | 1.55 | 0.16 | 31.8 | 0.032 | 0.058 | 4.91 | 21:1 | 3.25 | 29.0 |
| PRACTICAL EXAMPLE 2 | 1.68 | 2.04 | 0.14 | 32.9 | 0.046 | 0.054 | 5.02 | 16:1 | 2.53 | 29.1 |
| PRACTICAL EXAMPLE 3 | 2.46 | 1.56 | 0.14 | 31.2 | 0.068 | 0.058 | 4.91 | 20:1 | 3.32 | 20.9 |
| PRACTICAL EXAMPLE 4 | 2.27 | 1.52 | 0.11 | 36.6 | 0.073 | 0.066 | 0.026 | 24:1 | 3.02 | 34.4 |
| PRACTICAL EXAMPLE 5 | 2.47 | 1.55 | 0.10 | 31.7 | 0.076 | 0.060 | 4.81 | 20:1 | 3.28 | 27.0 |
| PRACTICAL EXAMPLE 6 | 1.47 | 0.81 | 0.82 | 32.7 | 0.078 | 0.066 | 4.94 | 40:1 | 2.78 | 20.0 |
| PRACTICAL EXAMPLE 7 | 1.51 | 2.48 | 0.10 | 33.0 | 0.078 | 0.066 | 4.93 | 13:1 | 2.71 | 25.7 |
| PRACTICAL EXAMPLE 8 | 2.24 | 0.92 | 0.11 | 32.8 | 0.079 | 0.065 | 4.84 | 36:1 | 2.61 | 28.4 |
| PRACTICAL EXAMPLE 9 | 2.33 | 1.58 | 0.12 | 31.8 | 0.087 | 0.057 | 4.60 | 20:1 | 3.06 | 27.0 |
| PRACTICAL EXAMPLE 10 | 2.84 | 0.38 | 0.11 | 32.9 | 0.089 | 0.063 | 5.00 | 87:1 | 3.18 | 17.0 |
| PRACTICAL EXAMPLE 11 | 2.50 | 1.42 | 0.10 | 31.7 | 0.090 | 0.057 | 4.97 | 22:1 | 2.90 | 27.0 |
| PRACTICAL EXAMPLE 12 | 2.42 | 1.54 | 0.12 | 33.3 | 0.090 | 0.060 | 5.25 | 22:1 | 2.98 | 28.2 |
| PRACTICAL EXAMPLE 13 | 2.46 | 1.57 | 0.11 | 32.1 | 0.093 | 0.053 | 4.86 | 20:1 | 2.47 | 29.3 |
| PRACTICAL EXAMPLE 14 | 1.01 | 1.43 | 0.10 | 33.1 | 0.100 | 0.063 | 5.08 | 23:1 | 2.22 | 21.3 |
| PRACTICAL EXAMPLE 15 | 2.46 | 1.55 | 0.10 | 32.1 | 0.100 | 0.059 | 5.00 | 21:1 | 3.17 | 27.0 |
| PRACTICAL EXAMPLE 16 | 2.31 | 1.47 | 0.11 | 32.5 | 0.150 | 0.054 | 4.90 | 22:1 | 3.04 | 29.8 |
| PRACTICAL EXAMPLE 17 | 2.31 | 1.47 | 0.11 | 32.5 | 0.260 | 0.054 | 4.90 | 22:1 | 3.13 | 31.2 |
| PRACTICAL EXAMPLE 18 | 2.31 | 1.47 | 0.11 | 32.5 | 0.320 | 0.054 | 4.90 | 22:1 | 3.09 | 27.9 |
| PRACTICAL EXAMPLE 19 | 2.34 | 1.47 | 0.11 | 31.8 | 0.350 | 0.047 | 4.87 | 22:1 | 3.22 | 26.2 |
| COMPARATIVE EXAMPLE 1 | 2.26 | 2.44 | 0.61 | 28.8 | 0.011 | 0.058 | 4.91 | 12:1 | 4.59 | 9.7 |
| COMPARATIVE EXAMPLE 2 | 2.34 | 1.47 | 0.11 | 31.8 | 0.550 | 0.047 | 4.87 | 22:1 | 3.31 | 16.8 |

IRON ALLOY MATERIAL FOR CASTING AND IRON CASTING

CROSS REFERENCE TO RELATED APPLICATIONS

This application is a national stage application of International Application No. PCT/JP2021/038484, filed on Oct. 18, 2021, which designates the United States, the entire contents of which are herein incorporated by reference, and which is based upon and claims the benefit of priority to Japanese Patent Application No. 2020-178270, filed on Oct. 23, 2020, the entire contents of which are herein incorporated by reference.

FIELD

The present invention relates to an iron alloy material for casting and an iron casting.

BACKGROUND

Patent Literature 1 describes that, for a structural body/bodies of a machine tool, an electronic component manufacturing machine, a microscope, etc., where an ultra-high accuracy is required, a change of a dimension thereof that is caused by thermal expansion or thermal contraction thereof due to a temperature change near a room temperature has to be very small and a material with an extremely small rate of thermal expansion is desired (see paragraph [0002]).

Patent Literature 2 describes that, for a large and thick product or a thick part of a product where a cooling rate thereof is low, an eutectic solidification time is long so that chunky graphite that is an unusual graphite texture is readily crystallized in a metal texture of a spheroidal graphite cast iron, and a Young's modulus, a tensile strength, and an elongation of a cast iron material are significantly decreased due to crystallization of chunky graphite (see paragraph [0003]).

With reference to Patent Literatures 1 and 2, reducing thermal expansion and improving an elongation is not readily attained.

CITATION LIST

Patent Literature

Patent Literature 1: Japanese Patent Application Publication No. 2001-192777

Patent Literature 2: International Publication No. 2015/034062

SUMMARY

Technical Problem

An iron alloy material for casting that is capable of reducing thermal expansion and improving an elongation is provided.

Solution to Problem

An aspect of the present invention is an iron alloy material for casting that includes 0.3 to 3.5 mass % of C, 0.1 to 3.0 mass % of Si, 26.0 to 42.0 mass % of Ni, 0.02 to 0.50 mass % of Sb, and a balance that is Fe and an inevitable impurity/impurities.

In such an iron alloy material for casting, a content of Si is 0.1 to 3.0 mass %, so that a coefficient of thermal expansion is reduced. Moreover, a content of C is 0.3 to 3.5 mass %, so that a tendency of graphite that is crystallized at a time of solidification thereof to form a eutectic texture thereof is increased so as to increase an amount of expansion of graphite and prevent or reduce generation of a shrinkage cavity therein. Moreover, a content of Ni is 26.0 to 42.0 mass %, so that Ni is segregated around graphite and Si is segregated in a finally solidified part, and a content of Sb is 0.02 to 0.50 mass %, so that Sb effectively acts on not only Ni that is concentrated around graphite but also Si that is concentrated in a finally solidified part. Thereby, it is possible to increase a number of a graphite particle(s) in respective areas with concentrated Ni and Si that act as graphitization acceleration elements. Hence, it is possible to prevent or reduce growing of C where a tendency of formation of a eutectic texture is increased so as to readily enhance an action of graphitization into chunky graphite (unusual graphite). Therefore, it is possible to provide an iron alloy material for casting that is capable of reducing thermal expansion and improving an elongation.

It is preferable that an iron alloy material for casting further includes 0.001 to 6.0 mass % of Co. A content of Co is 0.001 to 6.0 mass %, so that it is possible to further reduce a coefficient of thermal expansion, due to effect of synergy with Ni.

It is preferable that an iron alloy material for casting further includes 0.01 to 1.4 mass % of Mn. In such an iron alloy material for casting, a content of Ni is 26.0 to 42.0 mass % and a content of Mn is 0.01 to 1.4 mass %, so that it is possible to stabilize austenite so as to prevent or reduce generation of martensite. Therefore, it is possible to improve a cutting property of an iron casting that is provided by using and casting such an iron alloy material for casting.

It is preferable that an iron alloy material for casting further includes 0.01 to 0.1 mass % of Mg. A content of Mg is 0.01 to 0.1 mass %, so that it is possible to enhance an action of spheroidizing of graphite and segregate Mg in a finally solidified part. Hence, not only Sb but also a compound of Sb and Mg readily acts on Si that is concentrated in a finally solidified part. Therefore, excessive graphitization of C is readily prevented or reduced due to Sb and a compound of Sb and Mg, so that generation of chunky graphite is prevented or reduced more readily.

Another aspect of the present invention is an iron casting that is provided by using and casting an iron alloy material for casting as described above. It is possible to provide an iron casting where thermal expansion thereof is reduced and an elongation thereof is improved.

BRIEF DESCRIPTION OF DRAWINGS

FIG. 1 is a diagram that illustrates compositions, coefficients of thermal expansion, and elongations of practical examples and comparative examples of an iron alloy material for casting.

DESCRIPTION OF EMBODIMENTS

Figure 2:
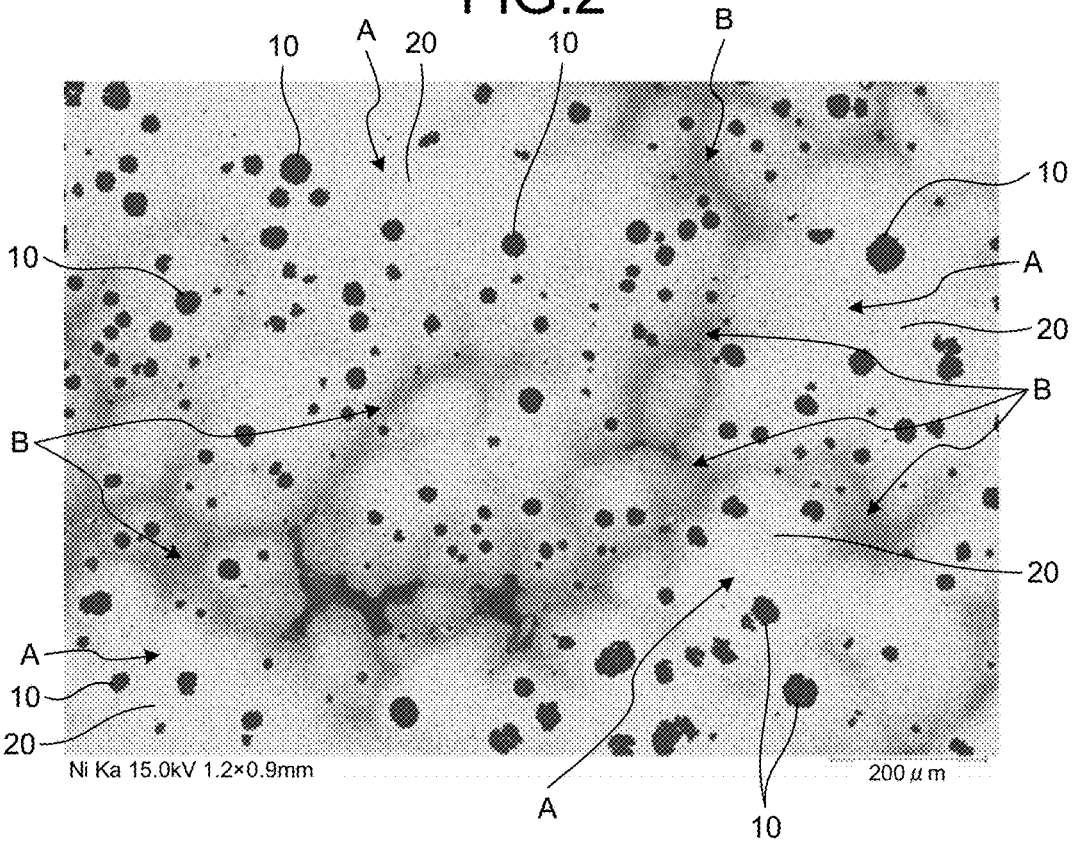
FIG. 2 is a diagram that illustrates a result of observation of Ni in a texture of a test piece of an iron alloy material for casting (practical example 15).

Hereinafter, an embodiment(s) of an iron alloy material for casting and an iron casting as disclosed in the present application will be explained with reference to the accompanying drawing(s). Additionally, the present invention is not limited to an undermentioned embodiment(s) and includes those specified in what is claimed.

First Embodiment

An iron ally material for casting according to a first embodiment includes 0.3 to 3.5 mass % of C, 0.1 to 3.0 mass % of Si, 26.0 to 42.0 mass % of Ni, 0.02 to 0.50 mass % of Sb, and a balance that is Fe and an inevitable impurity/impurities.

In the present embodiment, "casting" includes casting that is executed by various types of casting methods such as a sand mold casting method, a metallic mold casting method, and a die-casting method. Furthermore, an "iron alloy material" means an alloy material that includes an iron phase as a main phase thereof. Therefore, an "iron alloy material for casting" means an iron alloy material that is casted by various types of casting methods such as a sand mold casting method, a metallic mold casting method, and a die-casting method. A "mass %" of an element means a percentage of a mass of such an element in a mass of an iron alloy material for casting. For example, a representation of "A to B mass % of an element" means that a mass % of an element is A % or more and B % or less. A "balance" means a component (s) other than a listed element(s), among components that compose an iron alloy material for casting. For example, a representation of "An iron alloy material for casting that includes . . . C, . . . Si, . . . Ni, . . . Sb, and a balance that is Fe and an inevitable impurity/impurities." means that components other than C, Si, Ni, and Sb, among components that compose an iron alloy material for casting, are Fe and an inevitable impurity/impurities. The same also applies to an undermentioned embodiment(s).

(C: Carbon)

An iron alloy material for casting according to the first embodiment includes 0.3 to 3.5 mass % of C. In an iron alloy material for casting according to the present embodiment, a content of C is 0.3 to 3.5 mass %, so that a tendency of graphite that is crystallized at a time of solidification thereof to form a eutectic texture is increased and thereby an amount of expansion of graphite is increased so as to prevent or reduce generation of a shrinkage cavity therein. A lower limit of a content of C is 0.3 mass %, so that it is possible to lower a liquidus line temperature of an iron alloy material for casting. Hence, it is possible to improve fluidity of such an iron alloy material for casting. Furthermore, a lower limit of a content of C is 0.3 mass %, so that it is possible to increase an amount of crystallized graphite. Hence, it is possible to improve a cutting property of an iron casting that is provided by using and casting an iron alloy material for casting (that will simply be referred to as an "iron casting" below). Furthermore, an upper limit of a content of C is 3.5 mass %, so that it is possible to prevent or reduce graphite floatation (carbon floatation). Hence, it is possible to prevent or reduce degradation of strength and/or ductility of an iron casting. The same also applies to an undermentioned embodiment(s).

(Si: Silicon)

An iron alloy material for casting according to the first embodiment includes 0.1 to 3.0 mass % of Si. In an iron alloy material for casting according to the present embodiment, a content of Si is 0.1 to 3.0 mass %, so that a coefficient of thermal expansion is reduced. A lower limit of a content of Si is 0.1 mass %, so that it is possible to lower a liquidus line temperature of an iron alloy material for casting. Hence, it is possible to improve fluidity of such an iron alloy material for casting. Furthermore, a lower limit of a content of Si is 0.1 mass %, so that it is possible to increase a proportion of a content of Si to a content of C. Hence, it is possible to prevent or reduce formation of a CO gas. Therefore, it is possible to reduce a gas defect that is generated on a surface of an iron casting. Furthermore, an upper limit of a content of Si is 3.0 mass %, so that it is possible to reduce an amount of Si that is dissolved in Fe (an iron base). Hence, it is possible to prevent or reduce an increase of a coefficient of thermal expansion. Furthermore, an upper limit of a content of Si that acts as a graphitization acceleration element is 3.0 mass %, so that it is possible to prevent or reduce excessive graphitization of C. Hence, it is possible to prevent or reduce generation of chunky graphite. Therefore, it is possible to improve an elongation of an iron casting. The same also applies to an undermentioned embodiment(s).

(Ni: Nickel)

An iron alloy material for casting according to the first embodiment includes 26.0 to 42.0 mass % of Ni. In an iron alloy material for casting according to the present embodiment, a content of Ni is 26.0 to 42.0 mass %, so that Ni is segregated around graphite, and as a result, Si is segregated in a finally solidified part. That is, Ni is concentrated in an area around graphite, so that austenite is stabilized and Si is concentrated in a finally solidified part that is provided on a side of a residual fluid. A lower limit of a content of Ni is 26.0 mass %, so that it is possible to stabilize austenite so as to prevent or reduce generation of martensite. Hence, it is possible to prevent or reduce degradation of ductility of an iron casting and improve a cutting property of such an iron casting. Furthermore, an upper limit of a content of Ni is 42.0 mass %, so that it is possible to prevent or reduce an increase of a coefficient of thermal expansion. Furthermore, an upper limit of a content of Ni that acts as a graphitization acceleration element is 42.0 mass %, so that it is possible to prevent or reduce excessive graphitization of C. Hence, it is possible to prevent or reduce generation of chunky graphite. Therefore, it is possible to improve an elongation of an iron casting. The same also applies to an undermentioned embodiment(s).

(Sb: Antimony)

An iron alloy material for casting according to the first embodiment includes 0.02 to 0.50 mass % of Sb. In an iron alloy material for casting according to the present embodiment, a content of Sb is 0.02 to 0.50 mass %, so that Sb effectively acts on not only Ni that is concentrated around graphite but also Si that is concentrated in a finally solidified part. That is, Sb effectively acts in not only an area with concentrated Ni near graphite but also an area with concentrated Si that is separate from graphite. Thereby, it is possible to increase a number of a graphite particle(s) in respective areas with concentrated Ni and Si that act as graphitization acceleration elements and prevent or reduce excessive growth of graphite. Hence, it is possible to prevent or reduce growing of C where a tendency of formation of a eutectic texture is increased so as to readily enhance an action of graphitization into chunky graphite. Therefore, it is possible to reduce thermal expansion of an iron casting and improve an elongation thereof. Moreover, in an iron alloy material for casting according to the present embodiment, a content of Ni is 26.0 to 42.0 mass %, so that Ni is concentrated in an area around graphite so as to stabilize austenite. Hence, it is also possible to prevent or reduce generation of spiky graphite. Therefore, it is also possible to prevent or reduce embrittlement of an iron casting. A lower limit of a content of Sb is 0.02 mass %, so that it is possible to prevent or reduce generating of chunky graphite in a thick part that is readily provided as a finally solidified part even when an iron casting has such a thick part. Hence, an elongation of an iron casting that has a thick part is readily improved. Furthermore, an upper limit of a content of Sb is 0.50 mass %, so that it is possible to prevent or reduce generation of spiky graphite and/or a defect of spheroidizing that is associated with an excessive increase of a compound of Sb and Mg. The same also applies to an undermentioned embodiment(s).

(Fe: Iron, Inevitable Impurity/Impurities)

A balance in an iron alloy material for casting according to the first embodiment is Fe and an inevitable impurity/impurities. For an inevitable impurity/impurities that is/are included in a balance, for example, an element(s) such as P (phosphorus), S (sulfur), Cu (copper), Al (aluminum), Cr (chromium), Mo (molybdenum), V (vanadium), and/or Ti (titanium) is/are provided. It is preferable that a content(s) of an inevitable impurity/impurities is/are, for example, 5.0 mass % or less in total, and it is more preferable that it/they is/are 3.0 mass % or less in total or 1.0 mass % or less in total. The same also applies to an undermentioned embodiment(s).

In an iron alloy material for casting according to the present embodiment, it is preferable that a ratio of a content of Ni to a content of Si is "10 to 100:1", it is more preferable that it is "10 to 90:1" or "13 to 50:1", and it is more preferable that it is "15 to 40:1", "17 to 35:1", or "19 to 34:1". A ratio of a content of Ni to a content of Si is thus provided, so that Ni is concentrated in an area around graphite and Si is concentrated in a finally solidified part that is provided on a side of a residual fluid, more readily. The same also applies to an undermentioned embodiment(s).

In an iron alloy material for casting according to the present embodiment, it is preferable that a lower limit of a content of Sb is 0.03 mass %, and it is more preferable that it is 0.045 mass %, 0.07 mass %, or 0.085 mass %. Furthermore, it is preferable that an upper limit of a content of Sb is 0.45 mass %, it is more preferable that it is 0.40 mass %, it is more preferable that it is 0.35 mass %, it is more preferable that it is 0.32 mass %, it is more preferable that it is 0.30 mass %, and it is more preferable that it is 0.26 mass %. A lower limit and an upper limit of a content of Sb are thus provided, so that Sb effectively acts in not only an area with concentrated Ni near graphite but also an area with concentrated Si that is separate from graphite, more readily. Therefore, thermal expansion of an iron casting is reduced and an elongation thereof is improved, more readily.

Alternatively, a situation that thermal expansion is extremely increased or an elongation is extremely decreased is prevented or reduced, so that both thermal expansion and an elongation are readily developed with balance. The same also applies to an undermentioned embodiment(s).

In an iron alloy material for casting according to the present embodiment, it is preferable that a lower limit of a content of C is 0.4 mass %, it is more preferable that it is 0.7 mass %, it is more preferable that it is 1.0 mass %, it is more preferable that it is 1.25 mass %, and it is more preferable that it is 1.5 mass %. Furthermore, it is preferable that an upper limit of a content of C is 3.3 mass %, it is more preferable that it is 3.0 mass %, it is more preferable that it is 2.75 mass %, and it is more preferable that it is 2.5 mass %. It is preferable that a lower limit of a content of Si is 1.0 mass %, it is more preferable that it is 1.2 mass %, and it is more preferable that it is 1.4 mass %. Furthermore, it is preferable that an upper limit of a content of Si is 2.5 mass %, it is more preferable that it is 2.3 mass %, and it is more preferable that it is 2.1 mass %. It is preferable that a lower limit of a content of Ni is 28.5 mass %, and it is more preferable that it is 31.0 mass %. Furthermore, it is preferable that an upper limit of a content of Ni is 38.0 mass %, it is more preferable that it is 36.0 mass %, and it is more preferable that it is 34.0 mass %. A lower limit and an upper limit of each of contents of C, Si, and Ni are thus provided, so as to readily reduce thermal expansion of an iron casting and improve an elongation thereof. The same also applies to an undermentioned embodiment(s).

Second Embodiment

An iron alloy material for casting according to a second embodiment includes 0.3 to 3.5 mass % of C, 0.1 to 3.0 mass % of Si, 26.0 to 42.0 mass % of Ni, 0.02 to 0.50 mass % of Sb, 0.001 to 6.0 mass % of Co, and a balance that is Fe and an inevitable impurity/impurities.

(Co: Cobalt)

An iron alloy material for casting according to the second embodiment includes 0.001 to 6.0 mass % of Co. In an iron alloy material for casting according to the present embodiment, a content of Co is 0.001 to 6.0 mass %, so that it is possible to further reduce a coefficient of thermal expansion, due to effect of synergy with Ni. A lower limit of a content of Co is 0.001 mass %, so that it is possible to decrease a local minimum value of a coefficient of thermal expansion, due to effect of synergy with Ni. Furthermore, an upper limit of a content of Co is 6.0 mass %, so that it is possible to prevent or reduce increasing of a coefficient of thermal expansion, after indicating a local minimum value thereof, in association with excessive addition of Co.

In an iron alloy material for casting according to the present embodiment, it is preferable that a lower limit of a content of Co is 0.01 mass %, and it is more preferable that it is 4.0 mass %. Furthermore, it is preferable that a content of Co is 4.0 to 5.5 mass %, for a content of Ni that is 31.0 to 34.0 mass %. A lower limit and an upper limit of a content of Co are thus provided, so as to reduce a coefficient of thermal expansion more readily, due to effect of synergy with Ni.

Third Embodiment

An iron alloy material for casting according to a third embodiment includes 0.3 to 3.5 mass % of C, 0.1 to 3.0 mass % of Si, 26.0 to 42.0 mass % of Ni, 0.02 to 0.50 mass % of Sb, 0.01 to 1.4 mass % of Mn, and a balance that is Fe and an inevitable impurity/impurities.

(Mn: Manganese)

An iron alloy material for casting according to the third embodiment includes 0.01 to 1.4 mass % of Mn. In an iron alloy material for casting according to the present embodiment, a content of Mn is 0.01 to 1.4 mass %, so that it is possible to stabilize austenite, due to effect of synergy with Ni, so as to prevent or reduce generation of martensite. Therefore, it is possible to improve a cutting property of an iron casting. A lower limit of a content of Mn is 0.01 mass %, so that it is possible to stabilize austenite, even at an ordinary temperature. Furthermore, an upper limit of a content of Mn is 1.4 mass %, so that it is possible to reduce an amount of Mn that is dissolved in Fe (an iron base).

Hence, it is possible to prevent or reduce an increase of a coefficient of thermal expansion.

In an iron alloy material for casting according to the present embodiment, it is preferable that a lower limit of a content of Mn is 0.08 mass %. Furthermore, it is preferable that an upper limit of a content of Mn is 0.85 mass %, and it is more preferable that it is 0.2 mass %. A lower limit and an upper limit of a content of Mn are thus provided, so that austenite is stabilized, due to effect of synergy with Ni, so as to prevent or reduce generation of martensite more readily.

Fourth Embodiment

An iron alloy material for casting according to a fourth embodiment includes 0.3 to 3.5 mass % of C, 0.1 to 3.0 mass % of Si, 26.0 to 42.0 mass % of Ni, 0.02 to 0.50 mass % of Sb, 0.01 to 0.1 mass % of Mg, and a balance that is Fe and an inevitable impurity/impurities.

(Mg: Magnesium)

An iron alloy material for casting according to the fourth embodiment includes 0.01 to 0.1 mass % of Mg. In an iron alloy material for casting according to the present embodiment, a content of Mg is 0.01 to 0.1 mass %, so that it is possible to enhance an action of spheroidizing of graphite and segregate Mg in a finally solidified part. Hence, not only Sb but also a compound of Sb and Mg readily acts on Si that is concentrated in a finally solidified part. Therefore, excessive graphitization of C is readily prevented or reduced due to Sb and a compound of Sb and Mg, so that generation of chunky graphite is prevented or reduced more readily. A lower limit of a content of Mg is 0.01 mass %, so that it is possible to enhance an action of spheroidizing of graphite. Furthermore, an upper limit of a content of Mg is 0.1 mass %, so that it is possible to prevent or reduce generation of an oxide or a sulfide of Mg. Hence, it is possible to prevent or reduce degradation of fluidity of an iron alloy material for casting. Moreover, it is possible to reduce a casting defect of an iron casting.

In an iron alloy material for casting according to the present embodiment, it is preferable that a lower limit of a content of Mg is 0.03 mass %, it is more preferable that it is 0.04 mass %, and it is more preferable that it is 0.05 mass %. Furthermore, it is preferable that an upper limit of a content of Mg is 0.08 mass %, and it is more preferable that it is 0.07 mass %. A lower limit and an upper limit of a content of Mg are thus provided, so that not only Sb but also a compound of Sb and Mg acts on Si that is concentrated in a finally solidified part, more readily.

An iron alloy material for casting according to an aforementioned embodiment(s) is used, so that it is possible to provide an iron casting where thermal expansion thereof is reduced and an elongation thereof is improved. Therefore, such an iron casting is preferable for a wide variety of applications that need (a) low (coefficient of) thermal expansion and a high elongation. For an example of an application of such an iron casting, a component(s), etc., of a semiconductor manufacturing apparatus, an electronic component manufacturing apparatus, a machine tool, etc., is/are provided.

Practical Examples

FIG. 1 illustrates compositions (mass %), coefficients of thermal expansion ($\times 10^{-6}$/° C.), and elongations (%) of practical examples and comparative examples of an iron alloy material for casting. The coefficients of thermal expansion ($\times 10^{-6}$/° C.) are values that were measured in accordance with JIS Z 2285 (measuring method of coefficient of linear thermal expansion of metallic materials) for test pieces of iron alloy materials for casting. FIG. 1 illustrates average coefficients of thermal expansion for a room temperature (25° C. standard) to 50° C. Furthermore, the elongations (%) are values that were measured in accordance with JIS Z 2241 (metallic material tensile testing method) for test pieces of iron alloy materials for casting. FIG. 1 illustrates elongations at a site with a thickness of 50 mm in a Y-block (type C).

Comparison Between Practical Examples 1 to 19 and Comparative Example 1

As illustrated in FIG. 1, contents of Sb in practical examples 1 to 19 were 0.02 mass % or more whereas a content of Sb in comparative example 1 was less than 0.02 mass %. Herein, coefficients of thermal expansion in practical examples 1 to 19 were $2.22\times10^{-6}$ to $3.32\times10^{-6}$/° C. whereas a coefficient of thermal expansion in comparative example 1 was $4.59\times10^{-6}$/° C. Hence, coefficients of thermal expansion in practical examples 1 to 19 were about 0.5 to 0.7 times greater than that in comparative example 1. Furthermore, elongations in practical examples 1 to 19 were 17.0 to 34.4% whereas an elongation in comparative example 1 was 9.7%. Hence, elongations in practical examples 1 to 19 were about 1.8 to 3.5 times greater than that in comparative example 1. Thus, it could be confirmed that, in practical examples 1 to 19, in an iron alloy material for casting that included 0.3 to 3.5 mass % of C, 0.1 to 3.0 mass % of Si, 0.01 to 1.4 mass % of Mn, 26.0 to 42.0 mass % of Ni, 0.01 to 0.1 mass % of Mg, and 0.001 to 6.0 mass % of Co, a lower limit of a content of Sb was 0.02 mass %, so that it was possible to reduce a coefficient of thermal expansion and improve an elongation.

Comparison Between Practical Examples 1 to 19 and Comparative Example 2

As illustrated in FIG. 1, contents of Sb in practical examples 1 to 19 were 0.50 mass % or less whereas a content of Sb in comparative example 2 was more than 0.50 mass %. Herein, coefficients of thermal expansion in practical examples 1 to 19 were $2.22\times10^{-6}$ to $3.32\times10^{-6}$/° C. whereas a coefficient of thermal expansion in comparative example 2 was $3.31\times10^{-6}$/° C. Hence, coefficients of thermal expansion in practical examples 1 to 19 were similar to or less than that in comparative example 2. Furthermore, elongations in practical examples 1 to 19 were 17.0 to 34.4% whereas an elongation in comparative example 2 was 16.8%. Hence, elongations in practical examples 1 to 19 were similar to, to about 2.0 times greater than that in comparative example 2. Thus, it could be confirmed that, in practical examples 1 to 19, in an iron alloy material for casting that included 0.3 to 3.5 mass % of C, 0.1 to 3.0 mass % of Si, 0.01 to 1.4 mass % of Mn, 26.0 to 42.0 mass % of Ni, 0.01 to 0.1 mass % of Mg, and 0.001 to 6.0 mass % of Co, an upper limit of a content of Sb was 0.50 mass %, so that it was possible to reduce a coefficient of thermal expansion and improve an elongation.

(Textures of Iron Alloy Materials for Casting)

Figure 3:
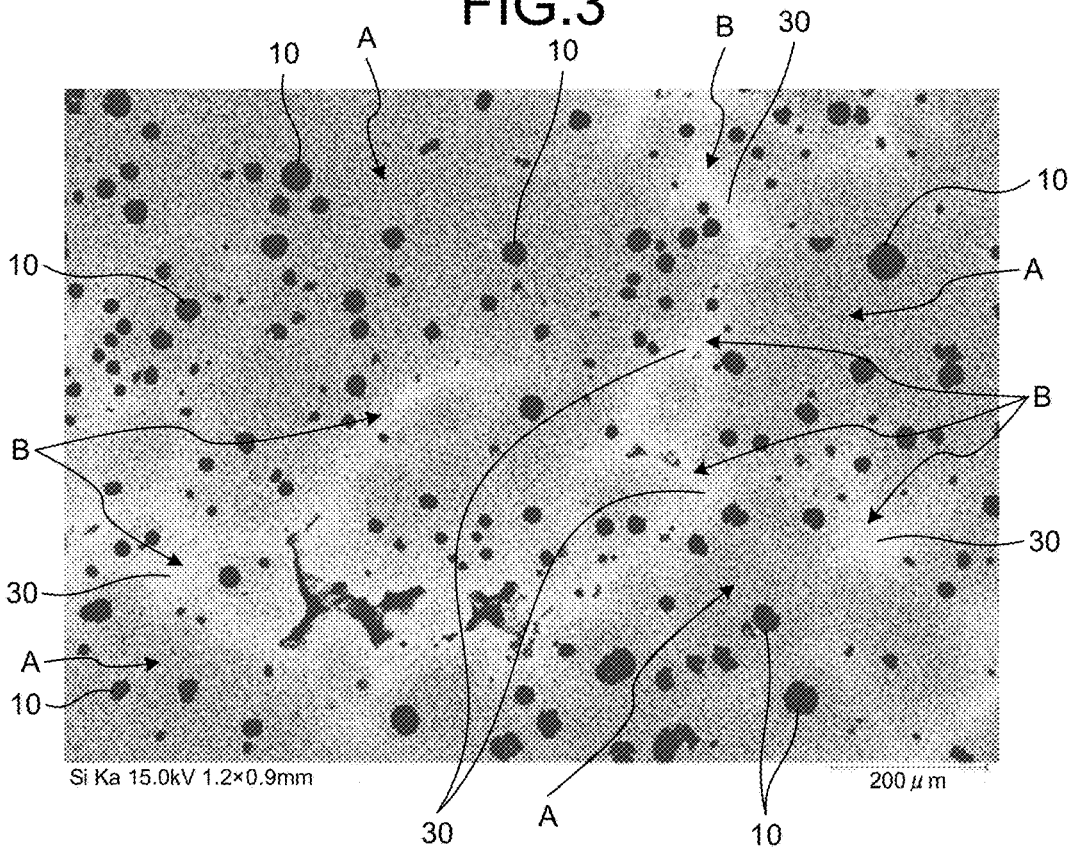
FIG. 3 is a diagram that illustrates a result of observation of Si in a texture of a test piece of an iron alloy material for casting (practical example 15).
Figure 4:
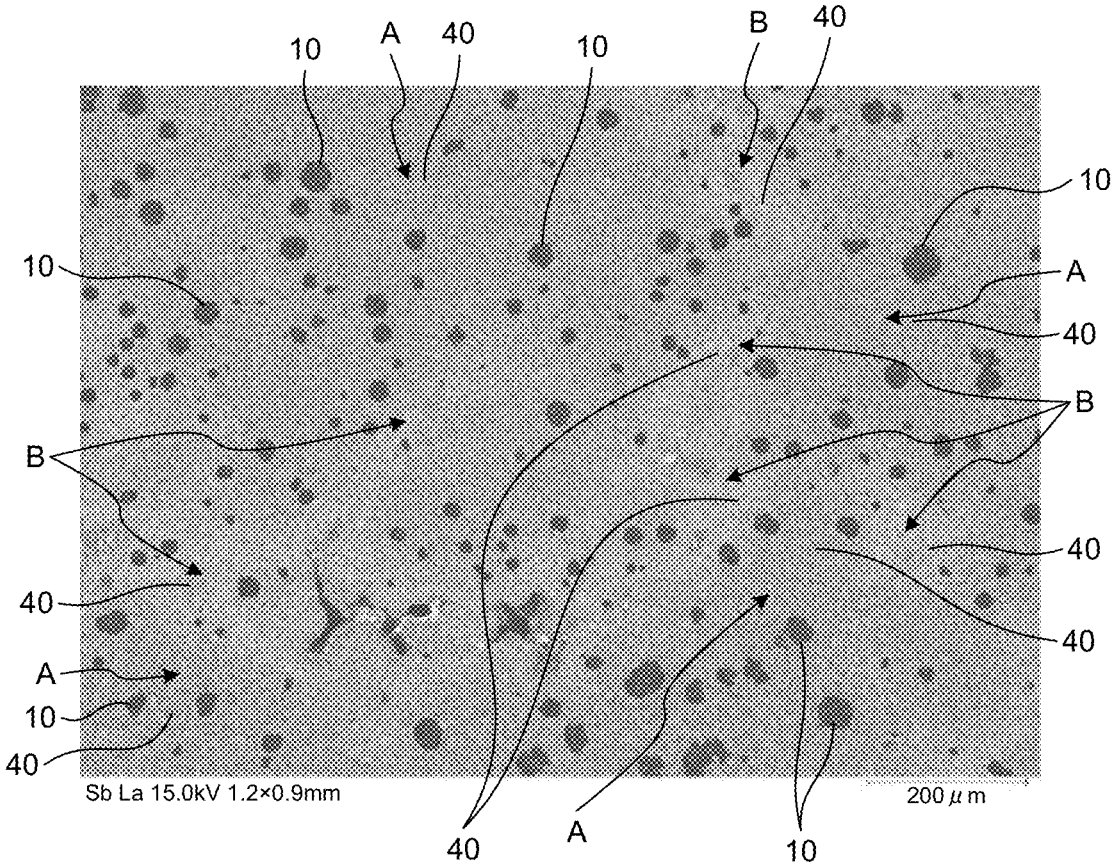
FIG. 4 is a diagram that illustrates a result of observation of Sb in a texture of a test piece of an iron alloy material for casting (practical example 15).

FIG. 2 to FIG. 4 illustrate results of observation on a texture of a test piece of an iron alloy material for casting (Practical Example 15). FIG. 2, FIG. 3, and FIG. 4 are diagrams that illustrate results of observation on states of distributions of Ni, Si, and Sb, by an electron-beam microanalyzer (EPMA).

As illustrated in FIG. 1, a content of Ni and a content of Si in practical example 15 were 32.1 mass % and 1.55 mass %. That is, a ratio of a content of Ni to a content of Si was "21:1". As illustrated in FIG. 2, in practical example 15, Ni phases 20 were distributed in areas A around graphite phases 10. Furthermore, as illustrated in FIG. 3, in practical example 15, Si phases 30 were distributed in finally solidified parts B that were separate from graphite phases 10. Thus, in practical example 15, a ratio of a content of Ni to a content of Si was "21:1", so that it was possible to concentrate Ni phases 20 in areas A around graphite phases 10 and concentrate Si phases 30 in finally solidified parts B that were separate from the graphite phases 10. Moreover, as illustrated in FIG. 1, in practical example 15, a content of Sb was 0.100 mass %. As illustrated in FIG. 4, in practical example 15, Sb phases 40 were evenly distributed from Ni phases 20 (see FIG. 2) that were distributed in areas A around graphite phases 10 to Si phases 30 (see FIG. 3) that were distributed in finally solidified parts B. Hence, it was possible for Sb to effectively act on not only Ni phases 20 that were concentrated in areas A around graphite phases 10 but also Si phases 30 that were concentrated in finally solidified parts B. Thereby, a number of graphite particles was increased in respective areas with concentrated Ni phases 20 and Si phases 30 that acted as graphitization acceleration elements, so that it was possible to prevent or reduce generation of chunky graphite. As a result, as illustrated in FIG. 1, in practical example 15, it was possible to reduce thermal expansion and improve an elongation.

Thus, as a result of observation on a texture of a test piece of an iron alloy material for casting, it could be confirmed that Ni phases 20 and Si phase 30 were concentrated in different areas, so that it was possible for Sb to effectively act in not only areas with concentrated Ni near graphite (areas around graphite phases 10) A but also areas with concentrated Si (finally solidified parts) B that were separate from graphite. As a result, as illustrated in FIG. 1, in practical examples 1 to 19, it was possible to reduce thermal expansion and improve an elongation. It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

REFERENCE SIGNS LIST

10 graphite phase
20 Ni phase
30 Si phase
40 Sb phase

The invention claimed is:

1. An iron alloy material for casting that consists of 0.7 to 3.5 mass % of C, 0.1 to 3.0 mass % of Si, 26.0 to 42.0 mass % of Ni, 0.02 to 0.50 mass % of Sb, 0.001 to 6.0 mass % of Co, 0.01 to 1.4 mass % of Mn, 0.01 to 0.1 mass % of Mg, and a balance that is Fe and inevitable elements, wherein the inevitable elements include Mo and Al, and a total of contents of the inevitable elements is 1.0 mass % or less.

* * * * *